US007225660B1

(12) United States Patent
Ledebur

(10) Patent No.: US 7,225,660 B1
(45) Date of Patent: Jun. 5, 2007

(54) APPARATUS AND METHOD FOR EXPANDING A TUBE DIAMETER AND A POLE FORMED THEREBY

(75) Inventor: Harry C. Ledebur, Ocean Shores, WA (US)

(73) Assignee: KW Industries, Inc., Sugar Land, TX (US)

( * ) Notice: Subject to any disclaimer, the term of this patent is extended or adjusted under 35 U.S.C. 154(b) by 22 days.

(21) Appl. No.: 11/127,722

(22) Filed: May 13, 2005

(51) Int. Cl.
*B21D 41/02* (2006.01)
*B21D 39/20* (2006.01)
*B21D 3/02* (2006.01)

(52) U.S. Cl. ..... 72/393; 72/123; 72/370.08

(58) Field of Classification Search ..... 72/123, 72/125, 276, 370.06, 370.08, 370.24, 391.2, 72/393
See application file for complete search history.

(56) References Cited

U.S. PATENT DOCUMENTS 1,494,128 A * 5/1924 Primrose ..... 72/370.08
2,254,275 A * 9/1941 Dove ..... 72/123
2,780,271 A * 2/1957 Ewart et al. ..... 72/342.3
3,041,990 A 7/1962 Le Fiell
3,330,145 A 7/1967 Adolphi
3,735,463 A 5/1973 Merola
3,879,977 A 4/1975 Cauffiel
4,622,841 A 11/1986 Yoshida
5,315,854 A 5/1994 Ledebur

* cited by examiner

*Primary Examiner*—Lowell A. Larson
*Assistant Examiner*—Teresa M. Bonk
(74) *Attorney, Agent, or Firm*—Egbert Law Offices

(57) ABSTRACT

A method of expanding a diameter of a tube includes the steps of positioning the tube with one end abutting a stop member, extending a mandrel through an interior passageway of the tube, and expanding a diameter of an expandable head connected to the mandrel as the mandrel is moved in a direction toward the stop member. The diameter of the tube expands in correspondence with the expansion of the diameter of the mandrel. A longitudinal axial force is applied to the tube in a direction toward the stop member as the expandable head expands the diameter of the tube.

15 Claims, 5 Drawing Sheets

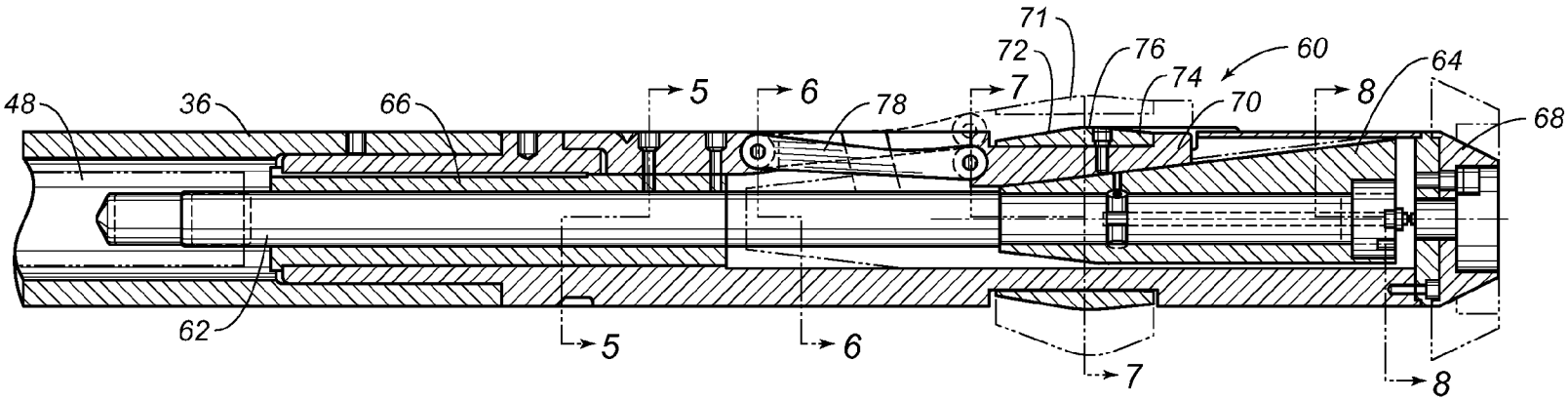
FIG. 4
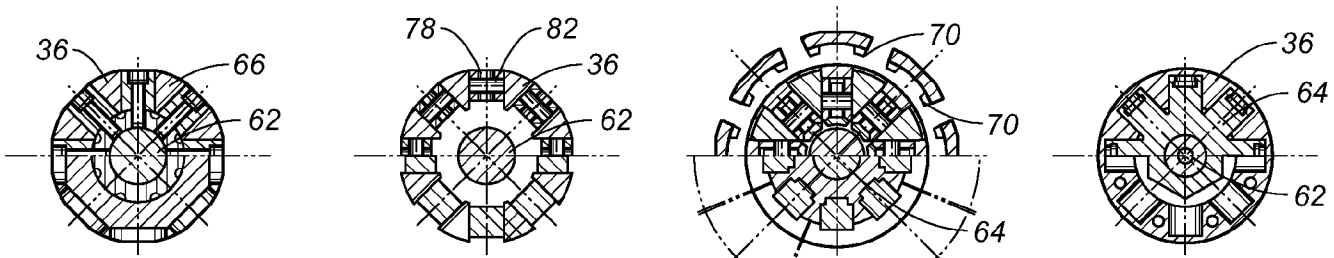
FIG. 8
FIG. 7
FIG. 6
FIG. 5

APPARATUS AND METHOD FOR EXPANDING A TUBE DIAMETER AND A POLE FORMED THEREBY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to tube forming methods and apparatus. More particularly, the present invention relates to techniques for expanding a tube diameter by the application of forces to the interior wall of the tube. Additionally, the present invention relates to methods and apparatus for expanding the diameter of the tube whereby a compressive force is applied to the tube as the tube diameter expands. The present invention also relates to poles that are formed through the method of expanding the tube diameter.

BACKGROUND OF THE INVENTION

Tubes of the type having larger diameters at the base and smaller diameters at the top are often used for street lights, signs, etc. Many times, these are made from nested cylindrical tubes of varying diameters which nest within one another and are welded together at their junctions. These techniques are generally slow and expensive and require more metal than necessary for the proper strength. These operations require machinery which is both costly and space consuming.

Alternatively, tubular members are tapered to a variety of useful shapes by conventional swaging operations. In these operations, the uniform wall thickness of the tubular member is swaged to reduce the diameter of the member at selected portions with the consequent result that the wall thickness increases at the reduced diameter portion. The swaging process includes multiple steps which are different and separate from each other. An initial stock must be passed through the step-by-step procedures until it can finally be finished to a desired shape. The steps start with cutting a flat metal blank to a tapered shape, followed by forming it to a tapered tubing with the opposite longitudinal edges left unjoined together. Then, the next step causes the edges of the tubing to be joined together by means of a welding process. Any undesired portions that are present along the welded edges of the tubing are removed by means of a polishing or finishing process. The manufacture of such a product involves many steps, each including different processes. As a whole, a combination of these processes permits the manufacture of the product. However, it is a highly inefficient mass production technique. This swaging process also increases the manufacturing cost for each item.

Single-step swaging processes are also known, in which the swaging machine is specifically designed to provide a small-length tapered metal tubing (such as forks for bicycles). For long tapered tubes which are between 12 and 30 feet long, such as lighting standards, it is practically impossible to implement a single-step swaging process.

Another type of tube tapering machine has been devised wherein tubular metal stock is rotated about its longitudinal central axis. During this rotation, spinning rolls or shoes work on the exterior of the tube to deform it from its initial cylindrical shape to a smaller diameter of either straight or tapered shape. The surface presented against the work piece or tubular stock by the rolls or shoes tends to bend or flex the metal of the tube wall in a direction opposed to its circumferential curve or configuration. This flexing, which is repeated revolution after revolution of the tube, has a tendency to produce longitudinal cracks or to propagate insignificant scratches on the tube wall into cracks. This is particularly true on the inner surface of the tube.

U.S. Pat. No. 3,879,977, issued on Apr. 29, 1975 to F. B. Cauffiel, describes an apparatus and method for producing tapered poles. In this patent, the tapered pole is made from a particular tapered strip which is wound in a pseudo-helical manner on a tapered mandrel. Suitable means are provided for directing and guiding the strip on the mandrel such that the strip is wound from the small end of the mandrel toward the large end. Welding procedures are provided so that the edges of the strips can be formed together so as to produce a tapered pole.

U.S. Pat. No. 3,735,463, issued on May 29, 1973 to A. Merola, describes a method of forming tapered tubular members. In this method, a generally uniform wall thickness, hollow, cylindrical body is utilized as the starting material. The body is elongated by engaging the body at two spaced portions along its length. By applying a predetermined force to the body of the engagement portion, a substantial component of the force is directed parallel to the longitudinal axis of the body. When the body elongates between the engaged positions, the wall thickness of the elongated portion is reduced a predetermined amount. The process described in U.S. Pat. No. 3,735,463 was designed for the production of ball bats through a conventional type of swaging process.

U.S. Pat. No. 3,041,990, issued on Jul. 3, 1962 to C. K. Le Fiell, describes a tube tapering machine. This machine tapers tubes by using a tool which works on the metal of the workpiece to deform it. This tool is in the form of an annular ring presenting a concave surface or line of contact toward the convex surface of the tubular stock.

U.S. Pat. No. 4,622,841, issued on Nov. 18, 1986 to K. Yoshida, shows a single-pass swaging operation. In this patent, several swaging units are arranged in series in a tandem configuration. Each swaging unit includes a flywheel which acts as an anvil. It also includes a set of metal dies. In the tandem configuration, the die sets and the swaging units are arranged sequentially from one to another. On the entry side of the tandem configuration machine, a tubing stock of a prescribed length (which is to be tapered) is inserted, progressing through the machine toward the other side thereof. While the tubing stock is being fed forward, it is sequentially processed by the dies in the swaging unit that provide the tapered shape over the length. After having been processed through all of the dies, the stock is formed to a totally tapered shape.

U.S. Pat. No. 3,330,145, issued on Jul. 11, 1967 to G. F. Adolphi, describes a machine and method for tapering rod-like tubular workpieces. In particular, this patent describes the technique in which a cylindrical tube is gripped at both ends and a tension is applied axially to the tube. The tube does not rotate during the forming pass but is rotated at the completion of each pass. This device is generally intended for the manufacturing of tapered tubes having a diameter of less than one inch.

U.S. Pat. No. 5,315,854, issued on May 31, 1994 to the present inventor, describes a tube tapering apparatus having a variable orifice die. This apparatus has a frame, a tubing receiving end connected to the frame, a variable-orifice die arranged so as to be movable relative to the frame, and an axial tension cylinder connected to the tube receiving end so as to apply tension forces to the tube. The variable-orifice die includes a stand having a housing and a plurality of die segments arranged within the housing. The die segments contain a circular groove of varying radius. The die segments define an orifice having an entry plane and an exit plane. The exit plane and the entry planes are offset from the plane of rotation of the die segments.

Each of these prior art patents is designed so as to form a tapered tube whereby forces are applied to the exterior of the tube. As such, a relatively large diameter tube is cold-formed so as to have a wide diameter end that matches the original diameter of the tube and a narrow diameter end that is less than the original diameter of the tube.

Since the cost of the steel material used for the formation of such tapered tubes is of great importance in the manufacture of tapered tubes, it is important to be able to minimize the amount of material that is used for the tube. As such, under certain circumstances, it may be desirable to expand a relatively narrow diameter original tube so as to have a wide diameter that is greater than the diameter of the original tube. This reduces the cost of the material involved in the formation of the tapered tube.

It is object of the present invention to provide a tube expanding method and apparatus which increases the diameter of a tube via forces applied to the interior of the tube.

It is another object of the present invention to provide a method and apparatus for forming a tube which enhances the tensile integrity of the tube in the narrow diameter portion.

It is a further object of the present invention to provide a tube expanding device which minimizes the cost of materials for the formation of the tapered tube.

It is still a further object of the present invention to provide a pole that is formed by the tube expanding method and apparatus of the present invention in which minimizes undesired harmonic effects.

It is still a further object of the present invention to pole that is manufactured by the method and apparatus of the present invention which minimizes effective projected area while maximizing yield strength for the pole.

It is still another object of the present invention to provide a method and apparatus for the expansion of a tube diameter which is easy to use and relatively inexpensive.

These and other objects and advantages of the present invention will become apparent from a reading of the attached specification and appended claims.

BRIEF SUMMARY OF THE INVENTION

The present invention is a method of expanding a diameter of a tube that comprises the steps of: (1) positioning the tube with one end abutting a stop member; (2) extending a mandrel through an interior passageway of the tube in which mandrel has an expandable head affixed thereto; and (3) expanding a diameter of an expandable head as the mandrel is moved in a direction toward the stop member. The diameter of the tube expands in correspondence with the expansion of the diameter of the expandable head of the mandrel. The method of the present invention further includes gripping an outer diameter of the tube at a location distal the stop member and moving the gripped outer diameter toward the stop member in relation to the expansion of the diameter of the expandable head.

This step of expanding includes forming the expandable head so as to have a plurality of shoes arranged around an outer diameter of a conical member, drawing the conical member in a direction toward the stop member, and pivoting the plurality of shoes radially outwardly during the step of drawing. A longitudinally axial force is applied to the tube in a direction toward the stop member as the diameter of the expandable head expands. The method of the present invention further includes loading the tube onto a support and then sliding the tube on the support so as to have one end abutting the stop member. The mandrel and the expandable head are removed from the interior passageway of the tube subsequent to the expansion steps. The tube is then lifted from the support.

The present invention is also an apparatus for expanding the diameter of the tube. This apparatus includes a frame having a stop member and a tube support extending from the stop member, a mandrel translatably connected to the frame so as to movable between a first position adjacent the stop member and a second position adjacent the tube support distal the stop member. An expandable is head interconnected to the mandrel. A gripping means is positioned away from the stop member. This gripping means applies a longitudinal axial force to the tube in a direction toward the stop member.

In the apparatus of the present invention, the frame has a carriage on a side of the stop member opposite the tube support. The mandrel extends along the carriage. A pull rod extends longitudinally through the mandrel. A conical member is connected to an end of the pull rod. The expandable head has a plurality of shoes having a surface juxtaposed against the conical member around an outer diameter of the conical member. Each of the plurality of shoes are pivotally connected to the mandrel. The shoes pivot outwardly as the conical member is moved by the pull rod in a direction toward the stop member. Each of the plurality of shoes has an inner surface having a tapered surface with an angle of taper generally matching an angle of taper of the conical member. Each of the plurality of shoes has an outer surface with a first surface extending at an obtuse angle with respect to a second surface. The outer surface has a vertex between these surfaces that defines an outermost edge of the shoe. Each of the plurality of shoes is pivotally connected at one end to a link. This link is pivotally connected to the mandrel. A drive means is connected to the pull rod for axially drawing the conical member in a direction toward the stop member. The stop member is a thrust plate extending transverse to a longitudinal axis of the tube support and the carriage. The mandrel is extendable through an interior of the thrust plate. The gripping means comprises a first gripper having an interior suitable for engaging a surface of the tube, a second gripper having an interior suitable for engaging another surface of the tube, and an actuator cooperative with the gripper so as to move the grippers so between a first position away from the tube and a second position engaging the tube. A push cylinder is connected to the first and second grippers so as to drive the first and second grippers in a direction toward the stop member. The tube support includes a first plurality of rollers rotatably connected to the tube support. Each of the first plurality of rollers has a spindle shape and is mounted so as to be rotatable about a horizontal axis. A second plurality of rollers is rotatably mounted to the tube support in spaced relationship to each other. Each of the second plurality of rollers is rotatable about a vertical axis.

The present invention is also a pole that is formed by the tube expansion method of the present invention. This pole comprises a base and a tube having one end affixed to the base and extending upwardly therefrom. The tube has a tapered portion with a wide diameter at the base. The tube has a constant diameter portion extending from an end of the tapered portion opposite the base. The tapered portion has a wall thickness that is identical to a wall thickness of the constant diameter portion. The base includes a first plate having a circular hole formed therein and a second plate in spaced parallel relation to the first plate. The tube has one end affixed to the second plate. The tapered portion extends through the circular hole and is affixed to the plate.

BRIEF DESCRIPTION OF THE SEVERAL VIEWS OF THE DRAWINGS

FIG. 4 is a cross-sectional view showing the mandrel and the expandable head of the present invention.

FIG. 5 is a cross-sectional view as taken across lines 5-5 of FIG. 4.

FIG. 6 is a cross-sectional view as taken across lines 6-6 of FIG. 4.

FIG. 7 is a cross-sectional view as taken across lines 7-7 of FIG. 4.

FIG. 8 is a cross-sectional view as taken across lines 8-8 of FIG. 4.

DETAILED DESCRIPTION OF THE INVENTION

Figure 1:
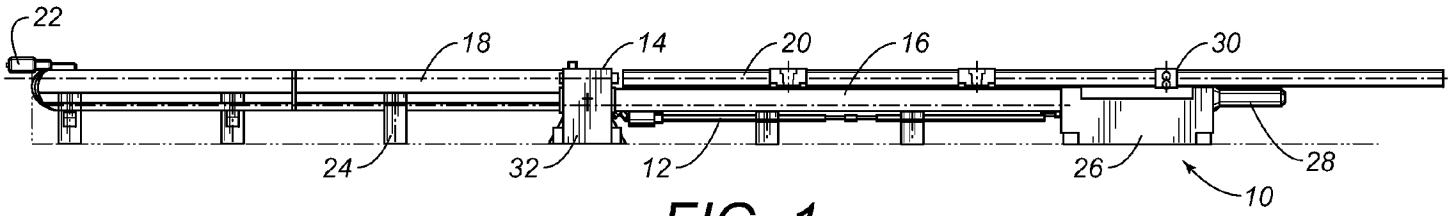
FIG. 1 is a side elevational view of the tube expanding apparatus of the present invention showing a tube as placed on a tube support thereof.

Referring to FIG. 1, there is shown the tube expanding apparatus 10 in accordance with the teachings of the present invention. The tube expanding apparatus 10 includes a frame 12 having a stop member 14 and a tube support 16 extending one side of the stop member 14. A carriage way 18 containing roller tracks on which a carriage rides as it transports a mandrel and a pull rod is positioned on the opposite side of the stop member 14. Tube 20 is illustrated as positioned on the tube support 16 and having an end juxtaposed against the stop member 14. A drive mechanism 22 is located at one end of the carriage way 18 and is used for moving the mandrel, and the associated pull rod, in a desired longitudinal manner. The carriage way 18 supports the mandrel and the pull rod longitudinally relative to the stop member 14. The tube 20 is supported on the tube support 16. A plurality of legs 24 extend downwardly from the carriage way 18 and the tube support 16 so as to support the frame 12 of the present invention upon an underlying surface. A gripping mechanism 26 is located at one end of the tube support 16 away from the stop member 14. A push cylinder 28 is cooperative with the gripping mechanism 26 so as to allow from the movement of the grippers for the purpose of applying an axially longitudinal force to the tube 20. Suitable grippers 30 engage the tube 20. When the push cylinder 28 is suitably actuated, the grippers 30 will move the tube 20 toward the stop member 14 at the same time that the expansion of the tube occurs. As a result of this arrangement, the expanded tube will have a constant wall thickness along its length. The stop member 14 is supported by an anchor stand 32 above the earth. The stop member 14 will be in the nature of the annular thrust plate. The stop member 14 can accommodate a number of interchangeable thrust rings of various sizes so as to suite the size of the tube being expanded. The end to the tube 20 will abut the thrust plate in the anchor stand 32.

Figure 2:
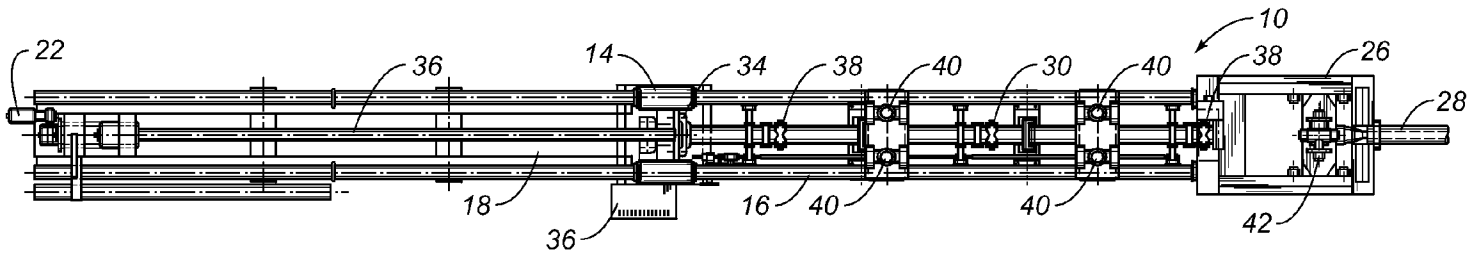
FIG. 2 is a plan view of tube expanding apparatus of the present invention.

FIG. 2 is a plan view of the tube expanding apparatus 10 of the present invention. In particular, in FIG. 2, it can be seen that the carriage 18 extends longitudinally to the base of the thrust plate 34 of stop member 14. A lubrication tank 36 is cooperative in the area of the thrust plate 34 so as to apply lubricant to the inside of the tube.

Mandrel 36 extends from the drive motor 22. When the drive motor is suitably operated, the mandrel 36 can be driven longitudinally axially through the thrust plate 34. It can be seen that the tube support 16 includes a first plurality of rollers 38 in spaced relationship along the length of the tube support 16. Rollers 38 are configured so as to have an axis of rotation extending horizontally. The rollers 28 have a generally spindle shape. As a result, the curved outer surface of the tube 20 can be rollably received therein. The rollers 38 facilitate the axial movement of the tube thereallong. A second plurality of rollers 40 are arranged in spaced relationship to each other. Each of the rollers 40 is mounted upon a vertical axis and rotatable thereabout. Rollers 40 provide a guide for the tube 16. The rollers 38 are adjustable in height to accommodate tubes of different diameters. These rollers 38 are retracted during tube expansion so as to allow for an increase in diameter of the tube. The side rollers remain in contact with the tube during expansion to brace the tube against possible buckling resulting from the axial compressive force. The side rollers are opened and closed by means of air cylinders to allow for loading of the tube and to allow for diameter increase during expansion. The push cylinder 28 is located at the end of the gripping mechanism 26. Grippers 42 are configured so as to grasp the outer diameter of the tube 20. As the tube expansion device expands the outer diameter of the tube, the grippers 42 are driven by the push cylinder 28 in the direction toward the stop member 14.

Figure 3:
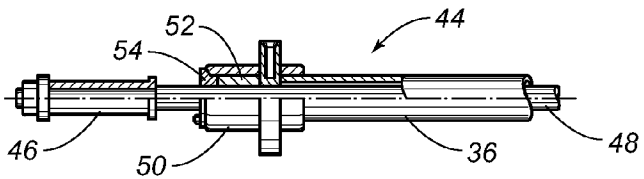
FIG. 3 is an partially broken-away view of the pull rod assembly as used in the present invention.

FIG. 3 is a detailed view of the pull rod assembly 44 of the present invention. The pull rod assembly 44 includes a sleeve 46 which extends around the pull rod 48. Mandrel 36 also extends around the pull rod 48. Mandrel end 50 is positioned over the pull rod 48 and supports the pull rod 48. A bushing 52 will be interposed between an inner wall of the mandrel 50 and an outer surface of the pull rod 48. Gland 54 is the annular space between the mandrel 36 and the pull rod 48. This serves as a conduit for the lubricant that is applied to the inside of the tube ahead of the expanding shoes. As a result of this arrangement, the pull rod 48 can be drivable independent of the driving of the mandrel 36. The sleeve 46 is part of the connection of the pull rod 48 to the cross head of the draw carriage which serves to move the pull rod 48 within the mandrel 36.

FIG. 4 shows the arrangement of the expandable head 60 as used in the present invention. Initially, the mandrel 36 extends over and around the pull rod 48. Pull rod 48 is in connection with the rod 62 that extends to a conical member 64. As used herein, the term conical member 64 can refer to a conical or frusto-conically shaped member having a smooth outer surface or a splined outer surface. In general, the conical member 64 has a wide end that tapers and narrows constantly in diameter to a narrow end. Sleeve 66 is interposed between the inner diameter of the mandrel 36 and the outer surface of rod 62. A nose plate 68 is affixed to the end of the mandrel 36 adjacent the wide end of the conical member 64.

Importantly, in the present invention, a plurality of shoe holders 70 are pivotally connected to the mandrel 36. In particular, as can be seen in FIG. 4, the shoe holders 70 have an inner surface that has an angle of taper matching the outer diameter of the conical member 64. A wear plate can be affixed to this inner surface so that a proper sliding motion can occur between the inner surface of the shoe holder 70 and the outer surface of the conical member 64. The outer surface of the shoe holder 70 has a shoe 71 and includes a first surface 72 and second surface 74 having a vertex 76 therebetween. Vertex 76 is an outermost surface of the shoe 70. Vertex 76 provides a point of contact with the inner wall of the tube for the purpose of initially expanding the tube. A link 78 is pivotally connected at one end to the shoe 70 and is pivotally connected at an opposite end to the mandrel 36. As can be seen by broken lines 80, the shoe 71 on the shoe holder 70 can be radially expandable outwardly of the mandrel 36 for the purpose of expanding the diameter of the tube. For reasons of economy, it is important that the expandable head 60 be capable of handling a range of tube sizes. Since the amount of shoe expansion is limited it is necessary that a number of interchangeable shoes 71 of varying thicknesses be provided. Each of these shoes 71 are fastened to the shoe holder 70 in order to accommodate various tube sizes. So as to change from one tube size to another, it is necessary to replace the shoes 71, the nose cone 68, the inserts for the pusher grips and the thrust ring. Additionally, the height of the support rollers 38 must be adjusted.

In normal use, the drive motor can have a threaded connection with the pull rod 48. As such, the drive motor will operate so as to pull on the pull rod 48 for the purpose of correspondingly pulling the rod 62 and the conical member 64 in a direction toward the stop member 14. The nose cone 68 is affixed to the mandrel 36 and secures to guide the mandrel as it enters the tube. A full description of this expansion is described hereinafter in association of FIGS. 12 and 13.

FIG. 5 is a cross-sectional view showing the manner in which the rod 62 extends centrally through interior of the sleeve 66 within the interior of the mandrel 36. FIG. 6 illustrates a cross-sectional view across lines 6-6 of FIG. 4. As can be seen, the link pin 82 pivotally supports link 78 thereover in a channel formed in the wall of the mandrel 36. Rod 62 extends centrally through the interior of the mandrel 36 and is generally spaced from the inner walls of the mandrel in this location.

FIG. 7 illustrates the configuration of the shoe holders 70 and the shoes 71 and their movement relative to the movement of the conical member 64. The broken line portion illustrates the area of maximum expansion of the shoes 71. When the shoes 71 are in their inwardmost position, they will generally form a continuously smooth outer surface. However, as the shoes 77 expand outwardly, the sides of each of the shoes will separate from each other. Since the spacing between each of the shoes will generally cause seams to appear on the expanded pipe, it is preferable, with the method of the present invention, to carry out at least two passes within the tube expansion apparatus of the present invention.

FIG. 8 shows that the conical member 64 has a generally splined configuration. Channels within the mandrel 36 serve to guide the motion of the conical member 64. Rod 62 extends centrally through the conical member 64 and is connected thereto so as to properly draw the conical member 64 along the inner surface of the shoe 70.

Figure 9:
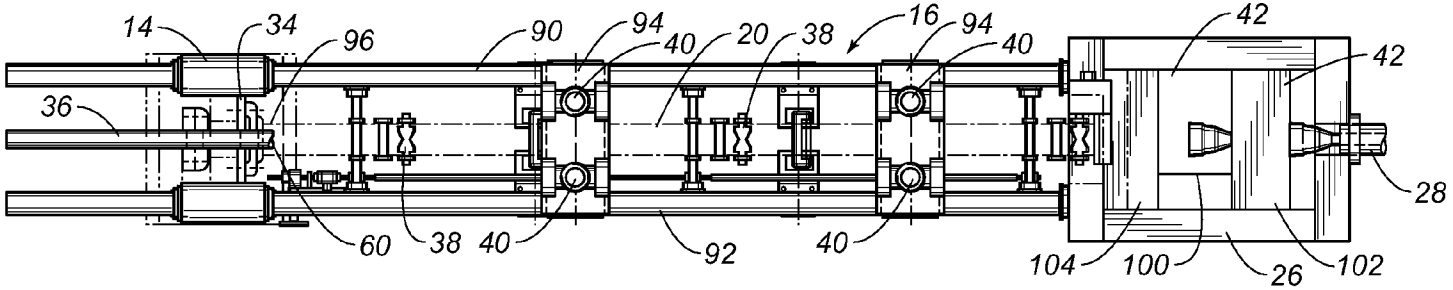
FIG. 9 is a plan view showing the tube support and gripping mechanism of the present invention.

FIG. 9 is a plan view of the tube support 16 of the present invention. In FIG. 9, the tube 20 is illustrated in broken line fashion. Tube 20 extends longitudinally centrally of the tube support 16. The tube support 16 has a pair of side rails 90 and 92 that extend in generally parallel planar relationship. Cross beams 94 support the rollers 40 thereon and also connect the side rails 90 and 92 together. The side rails 90 and 92 serve to tie the pusher housing to the anchor stand to counteract the reaction force resulting from the compressive force applied to the tube by the push cylinder 28. The rollers 40 are configured as guide rollers so as to stabilize the tube 20 therebetween. The first rollers 38 are positioned in spaced relationship to each other and also support the bottom side of the tube 20 thereon. It can be seen that the thrust plate 34 is located at one end of the tube support 16. The end 96 of the tube 20 will abut the thrust plate 34. The mandrel 36 is positioned such that the expandable head 60 can be directed into the interior of the tube 20. The hydraulic cylinder can be suitably actuated so as to move the mandrel 36 from the first position, as illustrated in FIG. 9, to a second position which is located away from the thrust plate 34 and in a position distal the stop member 14. The expandable head 60 can be placed in any location where it is desired to begin the expansion of the tube. The gripping mechanism 26 is located at the end of the tube support 16 opposite the stop member 14. Arrow 100 illustrates a desired amount of travel of the grippers 42 in the gripping mechanism 36. The push cylinder 28 is located at the end of the gripping assembly 26 and is interconnected to the grippers 42. When actuated, the push cylinder 28 will drive the grippers 42 from a first position 102 to the second position 104 (illustrated in broken line fashion). As a result, during the expansion of the tube 20, the wall thickness of the tube 20 is maintained constant by the force created by the push cylinder 28 and the axially longitudinal force imparted upon the tube 20 by the grippers 42. The rollers 40 will maintain the linearity of the tube 40 during the process.

Figure 10:
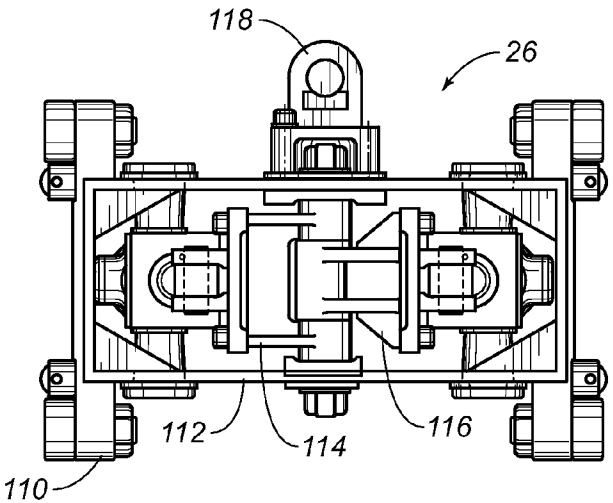
FIG. 10 is a plan view of the gripping assembly as used in the present invention.

FIG. 10 is a plan view of the gripping assembly 26. The gripping assembly 26 includes a carriage 110 which supports a housing 112. Grippers 114 and 116 are arranged so as to be movable between a first position away from the tube and a second position gripping the tube. The gripper assembly 26 is connected by clevis 118 to the push cylinder 28. As a result, motion created by the push cylinder 28 will drive the carriage 110 in a desired direction toward the stop member.

Figure 11:
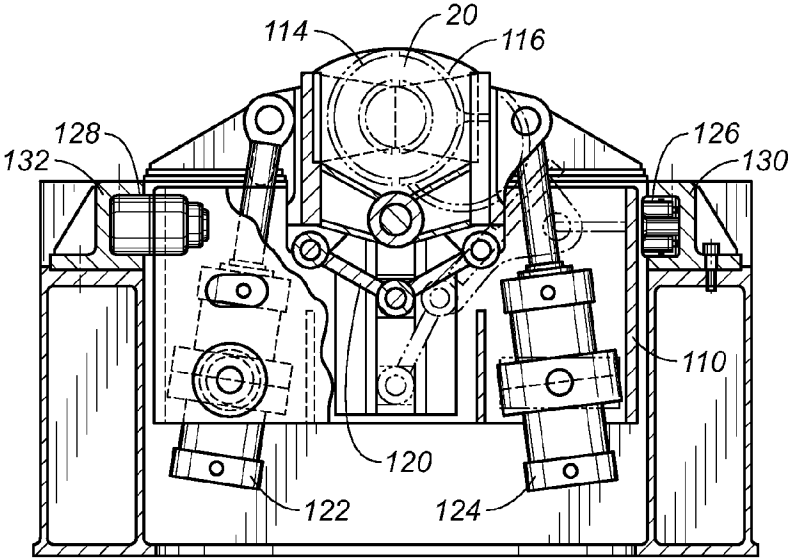
FIG. 11 is an end view showing the operation of the gripping assembly of the present invention.

FIG. 11 shows how the grippers 114 and 116 are configured so as to strongly grasp the outer diameter of the pipe 20 (illustrated in broken line fashion). An equalizer link 120 extends between the grippers 114 and 116. Hydraulic cylinders 122 and 124 are connected to the grippers 114 and 116. When actuated, the hydraulic cylinders 122 and 124 will drive the grippers 114 and 116 into a strong surfaceto-surface contact with the outer diameter of the tube 20. As can be seen, the carriage 110 has rollers 126 and 128 received within respective roller tracks 130 and 132. As a result, the carriage 110 can suitably translate longitudinally with respect to the tube expanding apparatus of the present invention. In order to accommodate various tube sizes, the grippers 114 and 116 are constructed to allow for the attachment of interchangeable pusher grips. A pair of grips having a the proper inside diameter is required for each tube diameter to be expanded.

Figure 12:
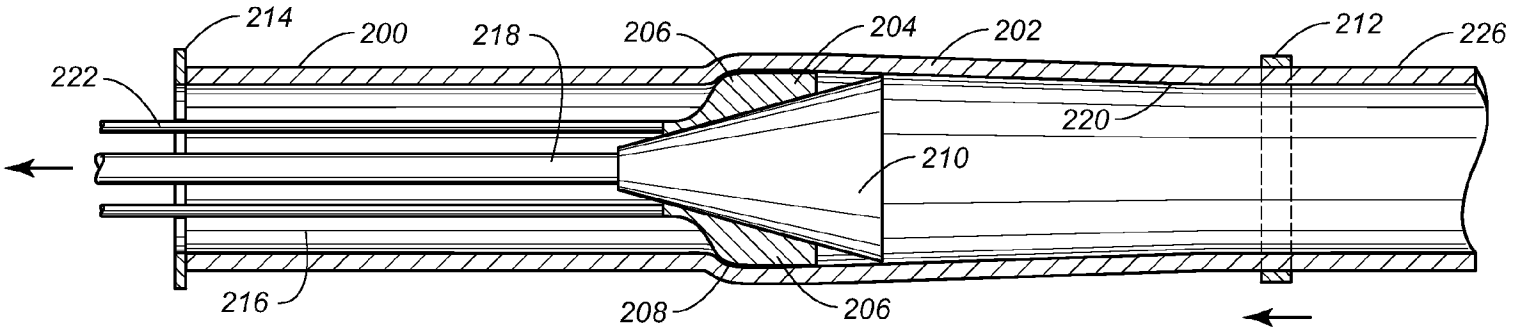
FIG. 12 is a diagrammatic illustration of a step of the method of the present invention showing an early expanding of the tube.

FIG. 12 illustrates the manner in which the expanded tube 200 can be suitably formed. As can be seen in FIG. 12, an area 202 of initial expansion is created by the expandable head 204. Expandable head 204 includes shoes 206 which have the vertex 208 initially forming the expanded area of the tube 200. The inner surface of each of the shoes 206 rides on the outer surface of the conical member 210. Grippers 212 engage the outer diameter of the tube 200 in a location on an opposite side of the expandable head 204 from the stop member 214.

Initially, the expandable head 204 and the conical member 210 are indexed through the interior passageway 216 of the tube 200 to a desired location. The pull rod 218 is then actuated so as to draw the conical member 210 toward the stop member 214. This causes the shoes 206 to slowly pivot outwardly toward the inner wall 220 of the tube 200. This will expand the outer diameter of the tube 200 in the manner illustrated in FIG. 12. Simultaneously, the grippers 221 will apply an longitudinal axial force to the tube 200 so as to compensate for the deflection of steel caused by the interaction of the shoes 204 with the inner wall of the tube 200. As a result, the wall thickness of the tube 200 will remain constant. Simultaneously, the mandrel 222 is drawn in a direction toward the stop member 14. This causes the shoes 206 to move along with the conical member 210.

Figure 13:
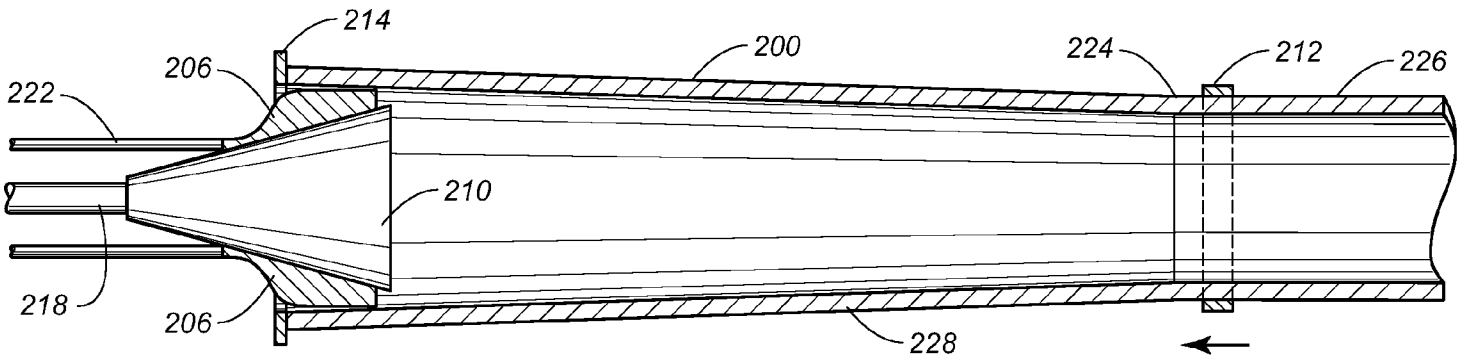
FIG. 13 is a diagrammatic illustration showing a later step of the method of the present invention.

FIG. 13 shows how the shoes 206 have fully expanded outwardly by cooperative movement with the outer wall of the conical member 210. The shoes 206 have been pivoted to their maximum extent. The tube 200 has its maximum diameter adjacent to the stop member 214. As a result, the tube 200 has been tapered evenly and smoothly from point 224. The remaining portion 226 of tube 200 will be straight. Gripper 212 has also moved toward the stop member 214 so as to compensate for the expansion of the tube 200.

Subsequent to the formation of the tapered section 228 of tube 200, the pull rod 218 and the mandrel 222 can be pulled through the opening of the stop member 214. The grippers 212 can be released from the outer diameter of the straight portion 226 so that the tube 200 can be removed from the tube support.

In the present invention, it can be seen that the present invention does not form an entirely tapered tube from one end to the other. If the entire tube needs to be tapered, then the straight section 226 can be separated from the tapered portion. In other circumstances, the partially tapered tube can be removed from the apparatus 10 and utilized with the tube tapering device, as described in U.S. Pat. No. 5,315,854 of the present inventor. This will facilitate the creation of an entirely tapered tube. The present invention achieves advantages by starting with the smaller diameter tube and expanding the diameter of the tube. The present invention permits the formation of a pole of effectively the same strength as a uniformly tapered pole having the same diameter at base and tip, but of less weight. As such, it is less expensive and easier to handle. Additionally, wind load is reduced.

Figure 14:
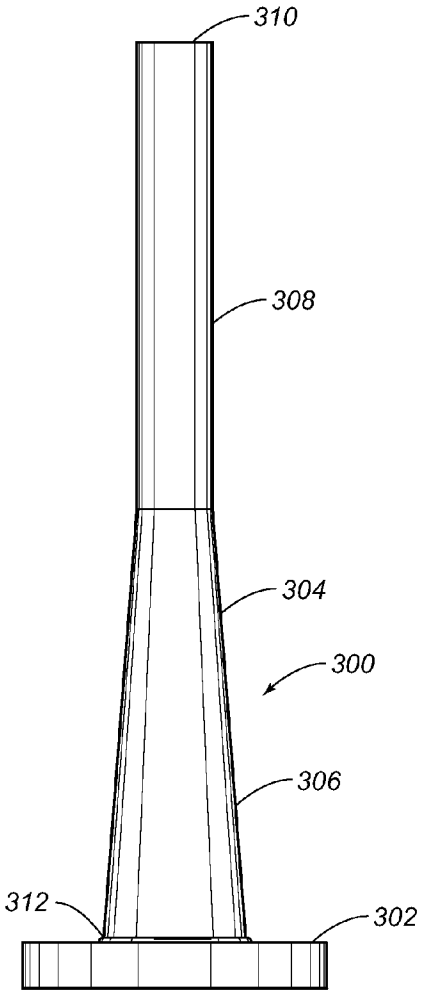
FIG. 14 is a side elevational view showing the pole as produced by the method of the present invention.

FIG. 14 illustrates a pole assembly 300 that has been created by the use of the method and apparatus of the present invention. As can be seen, the pole assembly 300 includes a base 302 with a pole 304 affixed thereto. The pole 304 has a tapered portion 306 having a wide diameter affixed to the base 302. A constant diameter section 308 extends from the end of the tapered portion 306 opposite the base 302. The tapered portion 306 has been formed by the tube expanding apparatus of the present invention. In the configuration of FIG. 14, the wide diameter end 312 of the pole assembly 300 will have the maximum tensile strength. The effective projected area of the pole assembly 304 is minimized since the constant diameter portion 308 is narrower than the tapering portion 304 and is located at a distance furthest away from the base 302. The yield strength of the pole assembly 300 is enhanced by the fact that the wide diameter end 312 of the tapered portion 306 is affixed to the base 302. It has been found that the harmonic problems associated with constant diameter pole assemblies are minimized by virtue of the transition between the constant diameter portion 308 and the tapered portion 306. Since the constant diameter portion 308 is not cold formed, the constant diameter portion 308 will maintain its maximum yield strength. As a result, the pole assembly 300 achieves enhanced structural integrity even over pole assemblies whereby the pole is of constant wide diameter.

Figure 15:
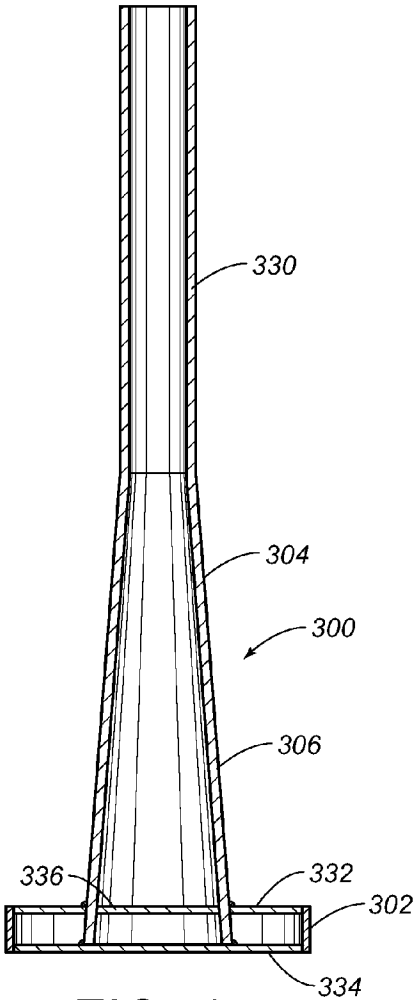
FIG. 15 is cross-sectional view showing a pole as produced by the method of the present invention.

FIG. 15 illustrates how the pole assembly 300 has a constant wall thickness 330 along its entire length. The tube expanding apparatus of the present invention assures that there is constant wall thickness along the entire length of the pole 304 of the pole assembly 300. It can be seen that the base 302 includes a first plate 332 and second plate 334. The tapered portion 306 has its lower end affixed to the second plate 334. A hole 336 is formed in the first plate 332. As a result, the tapered portion 306 will extend upwardly therethrough. By the nature of the tapered portion 306, the cross section of the tapered portion 306 will be absolutely circular. The outer wall of the tapered portion 306 can be suitably welded to the periphery of the hole 336 onto the first plate 332. This establishes a more secure connection between the bottom of pole 304 and the base 302.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A method of expanding a diameter of a tube comprising:

positioning the tube with one end abutting a stop member;

extending a mandrel through an interior passageway of the tube, said mandrel having an expandable head affixed thereto; and expanding a diameter of said expandable head as said mandrel is moved in a direction toward said stop member, the diameter of the tube expanding in correspondence with the expanding of said diameter of said expandable head, said step of expanding comprising:

forming said expandable head so as to have a plurality of shoes arranged around an outer diameter of a conical member;

drawing said conical member in a direction toward said stop member, said plurality of shoes having an inner surface moving along an outer surface of said conical member; and pivoting said plurality of shoes radially outwardly during said step of drawing.

2. The method of claim 1, further comprising:

gripping an outer diameter of the tube at a location distal said stop member; and moving the gripped outer diameter toward said stop member in relation to the expanding of said expandable head.

3. The method of claim 1, further comprising:

applying a longitudinal axial force to the tube in a direction toward the stop member as said diameter of said expandable head expands.

4. The method of claim 1, further comprising:

lowering the tube onto a support; and sliding the tube on said support so as to have said one end abutting said stop member.

5. The method of claim 4, further comprising:

removing said mandrel and said expandable head from said interior passageway of the tube; and lifting the tube from said support.

6. An apparatus for expanding a diameter of a tube comprising:

a frame having a stop member and a tube support extending from said stop member;

a mandrel translatably connected to said frame so as to movable between a first position adjacent said stop member and a second position adjacent said tube support distal said stop member;

an expandable head interconnected to said mandrel; and a gripping means positioned away from said stop member, said gripping means for applying a longitudinal axial force to the tube in a direction toward said stop member, said frame having a carriage on a side of said stop member opposite said tube support, said mandrel extending along said carriage.

7. The apparatus of claim 6, further comprising:

a pull rod extending longitudinally through said mandrel; and a conical member connected to an end of said pull rod, said expandable head having a plurality of shoes having a surface juxtaposed against said conical member around an outer diameter of said conical member.

8. The apparatus of claim 7, each of said plurality of shoes being pivotally connected to said mandrel, said plurality of shoes pivoting outwardly as said conical member is moved by said pull rod in a direction toward said stop member.

9. The apparatus of claim 8, said each of said plurality of shoes having an inner surface having a tapered surface with angle of taper generally matching an angle of taper of said conical member, each of said plurality of shoes having an outer surface with a first surface extending at an obtuse angle with respect to a second surface, said outer surface having a vertex between said first and second surfaces that is an outermost edge of the shoe.

10. The apparatus of claim 8, each of said plurality of shoes being pivotally connected at one end to a link, said link being pivotally connected to said mandrel.

11. The apparatus of claim 7, further comprising:

a drive means connected to said pull rod, said drive means for axially drawing said conical member in a direction toward said stop member.

12. An apparatus for expanding a diameter of a tube comprising:

a frame having a stop member and a tube support extending from said stop member;

a mandrel translatably connected to said frame so as to movable between a first position adjacent said stop member and a second position adjacent said tube support distal said stop member;

an expandable head interconnected to said mandrel; and a gripping means positioned away from said stop member, said gripping means for applying a longitudinal axial force to the tube in a direction toward said stop member, said stop member comprising a thrust plate extending transverse to a longitudinal axis of said tube support and said carriage, said mandrel extending through an interior of said thrust plate.

13. An apparatus for expanding a diameter of a tube comprising:

a frame having a stop member and a tube support extending from said stop member;

a mandrel translatably connected to said frame so as to movable between a first position adjacent said stop member and a second position adjacent said tube support distal said stop member;

an expandable head interconnected to said mandrel; and a gripping means positioned away from said stop member, said gripping means for applying a longitudinal axial force to the tube in a direction toward said stop member, said gripping means comprising:

a first gripper having an interior suitable for engaging a surface of the tube;

a second gripper having an interior suitable for engaging another surface of the tube; and an actuator cooperative with said first and second grippers so as to move said first and second grippers between a first position away from the tube and a second position engaging the tube.

14. The apparatus of claim 13, further comprising:

a push cylinder connected to said first and second grippers so as to drive said first and second grippers in a direction toward said stop member.

15. An apparatus for expanding a diameter of a tube comprising:

a frame having a stop member and a tube support extending from said stop member;

a mandrel translatably connected to said frame so as to movable between a first position adjacent said stop member and a second position adjacent said tube support distal said stop member;

an expandable head interconnected to said mandrel; and a gripping means positioned away from said stop member, said gripping means for applying a longitudinal axial force to the tube in a direction toward said stop member, said tube support comprising:

a first plurality of rollers rotatably mounted to said tube support, each of said first plurality of rollers having a spindle shape and mounted so as to be rotatable about a horizontal axis; and a second plurality of rollers rotatably mounted to said tube support in spaced relation to each other, each of said second plurality of rollers being rotatable about a vertical axis.

* * * * *